United States Patent [19]

Krausz

[11] 4,076,266

[45] Feb. 28, 1978

[54] BRAKE ASSEMBLY FOR SKATEBOARD

[76] Inventor: Howard I. Krausz, 513 12th St., Galveston, Tex. 77550

[21] Appl. No.: 695,740

[22] Filed: Jun. 14, 1976

[51] Int. Cl.[2] ..... A63C 17/14

[52] U.S. Cl. ..... 280/87.04 A; 188/2 D; 188/72.7; 280/11.2

[58] Field of Search ..... 280/87.04 A, 87.04 R, 280/11.2, 11.21, 11.11 R; 188/2 R, 2 D, 72.7, 74, 29; 180/1 G

[56] References Cited

U.S. PATENT DOCUMENTS

| | | | |
|---|---|---|---|
| 1,371,623 | 3/1921 | Ickenroth | 280/11.2 |
| 1,613,541 | 1/1927 | Smith | 188/72.7 |
| 2,953,389 | 9/1960 | Green et al. | 280/87.04 A |
| 3,288,251 | 11/1966 | Sakwa | 280/87.04 A |
| 3,385,608 | 5/1968 | Waddell | 280/11.2 |
| 3,744,339 | 7/1973 | Martinson | 188/2 D |
| 3,904,215 | 9/1975 | Bardy | 280/11.2 |
| 3,945,655 | 3/1976 | Banks et al. | 280/11.2 |

FOREIGN PATENT DOCUMENTS

| | | | |
|---|---|---|---|
| 301,363 | 10/1932 | Italy | 280/11.2 |
| 651,868 | 4/1951 | United Kingdom | 280/11.2 |

*Primary Examiner*—David M. Mitchell
*Attorney, Agent, or Firm*—Ralph S. Branscomb

[57] ABSTRACT

The invention is a manually operated brake for a skateboard which is connected by means of a tether cable to either the front or rear truck, there being two or more alternative means by which the braking of the wheels may be implemented, and the braking cable is disengageable from the skateboard so that the board may be alternatively used in the conventional fashion having no braking capacity.

3 Claims, 5 Drawing Figures

BRAKE ASSEMBLY FOR SKATEBOARD

Traditionally skateboards, which are undergoing a current resurgence of popularity, have had no braking capacity and frequently involve their users in accidents resulting in severe injury and even death. The sport of skateboarding is popular enough to have its own magazine and in at least some parts of the country fairly well organized skateboard races are put on in which speeds in excess of 60 miles per hour are achieved, and often obstacle course type races are engaged in as well. In addition, at least three dozen skate board parks are under construction or in the planning stage, and the large concentration of riders anticipated at these parks all using brake-less skateboards is a fearful and gruesome prospect.

In view of all this, although significant advances in urethane wheel design, wheel bearings, expanded truck assemblies, and flexible decks have been made, no braking system has achieved any degree of popularity despite the invention of one or more brake mechanisms for roller skates and skateboards. These mechanisms primarily are operated by foot movement and are thus clumsy if not downright dangerous since all foot and leg movements are required to achieve the precarious balance and steerage necessary for the precision operation of the skateboard, and an accidental application of the brakes by foot movement designed to effect steering could clearly be disastrous.

SUMMARY OF THE INVENTION

The present invention is a braking system for a skateboard utilizing only the hand movements so that the legs and feet are free to steer and balance and these latter functions are not complicated by the possibility of accidentally and unexpectedly braking the unit at 60 miles per hour.

The braking system in essence comprises a cable, preferably the sheath and core type, having a hand-operable grip at one end and connecting to brake shoes at the other end, the brake shoes applying pressure either to the side walls or the circumference of the rear wheels of the skateboard assembly. The braking assembly is preferably provided in a form which is quickly and easily desengageable from the skateboard so that in the event it is desired to use the board in conventional fashion, it is possible to do so in a simple manner, and reattachment of the cable is equally simple when the braking function is desired.

It has been found that the brake when manually controlled as ascribed to herein is effective not only in achieving the end of safety but also in increasing the overall speed when racing down a steep obstacle course, due to the improved control provided by the brake. Instead of side slipping or turning off course to reduce speed, a graded braking effect may be applied exactly when desired.

Utilization of an effective brake now permits skateboarding down narrow paths and allows greater flexibility in choosing locations of turns on hills, thus making the sport more enjoyable as well as less dangerous.

DETAILED DESCRIPTION OF THE PREFERRED EMBODIMENTS

Figure 1:
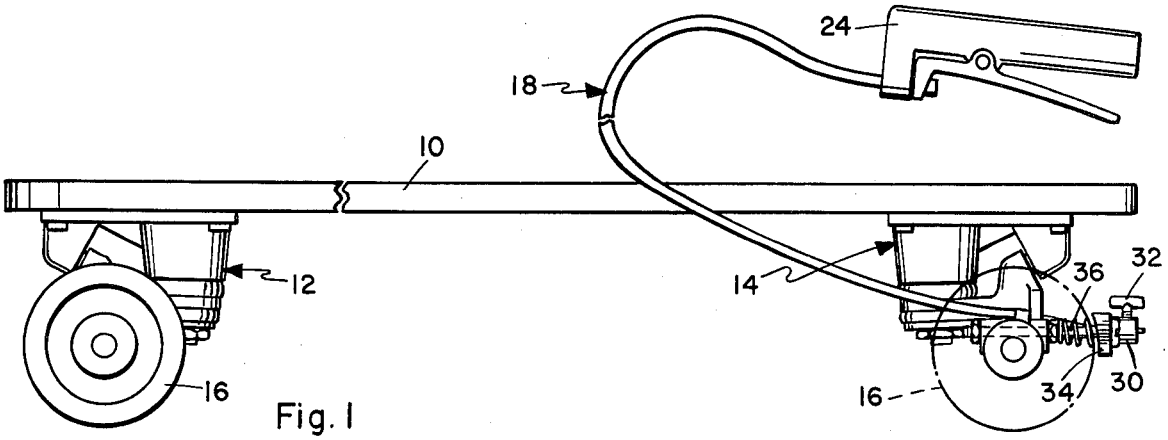
FIG. 1 is a side elevation view of a typical skateboard, with the brake system installed.

A skateboard is shown in FIG. 1 having a deck 10 and an undercarriage comprising front and rear trucks 12 and 14, respectively, these trucks each mounting a pair of coaxial wheels 16. The trucks are designed to cause the respective wheel pairs to turn somewhat in response to angulation of the deck such that the user may steer the skateboard by laterally shifting his weight. This feature, and the structure thus far described, is not affected by the invention, which may be attached to a conventional skateboard.

Figure 2:
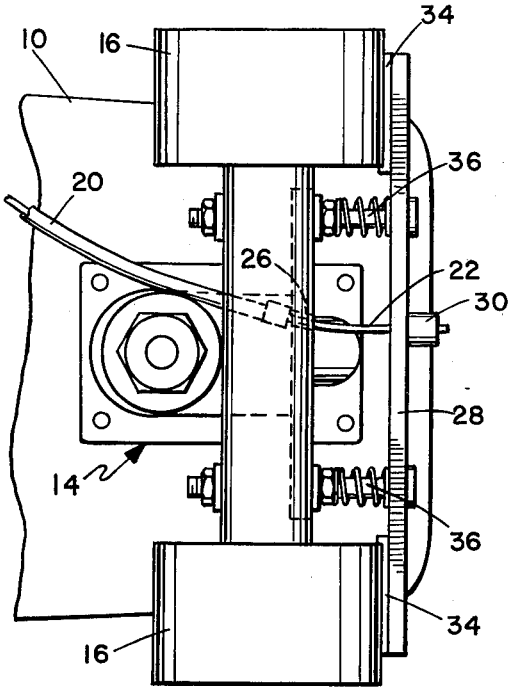
FIG. 2 is an enlarged underside view of the brake arrangement.

Referring now to the invention itself, in the first embodiment illustrated in FIGS. 1 and 2, a cable 18 of the type having an outer sheath 20 and an inner core 22 otherwise known as a bowden wire cable is operated by a hand grip 24 which clearly causes the core of the cable to be retracted relative to the sheath when the grip is squeezed. The core passes through a bore 26 in the truck and through a bar 28 and terminates in a retainer collar 30 which preferably is provided with a wing-type set screw 32 so that the cable is easily removable from the skateboard assembly. When the cable is attached as best shown in FIG. 1, it serves as an excellent tether or leash in addition to its braking cable function due to its inherent flexible nature.

To facilitate detachment of the cable to permit conventional use of the skateboard, the inner core could alternatively be divided into two segments joined by a hook and eyelet or similar fastener. The sheath may be held in a fixed mount with the aforementioned core fastener located between the mount and the truck. With this arrangement, the long segment of cable and the attached grip are easily detached by unfastening the core of this removable segment and releasing the sheath from its mount. The short end of the cable remains with the truck.

The bar 28 has a brake shoe 34 at each end thereof, and the bar is mounted to the truck by means of spring-loaded bolts 36, the spring being arranged such that clearly the bar will be biased away from the wheels unless cable pressure is applied, and upon the squeezing of the hand grip the cable core will draw the bar, and thus the brake shoes, against the wheels of the rear truck 14 to effect a braking action. It would also clearly be possible and perhaps desirable to brake the front which in addition to or instead of the rear wheel (the latter being effected by reversing the skateboard direction), although only one set of braked wheels has been shown for simplicity.

The cable is attached to the spanner bar 28 at its center as shown so that the pressure applied to the wheels will automatically equalize, inasmuch as the bar is able to pivot somewhat. In the same view, the bar will over a period of time inevitably wear down the wheels somewhat, and to readjust the clearance between the brake and the wheels the bolt 36 can be tightened. When this is done, and in any other instance in which the core of the cable becomes loose, slack can be taken up by adjusting the retainer 30, or by a threaded adjusting collar which is preferably provided on the sheath or the core cable at the hand grip. It should also be noted that although brake shoes 34 are shown as being members distinct from the spanner bar 28 they could in fact be formed by the bar itself in either its natural state or contoured somewhat.

Although the braking unit could be installed at the point of manufacture, in which case alternative mounting structure to the bolts 36 would likely be used, the structure as shown is designed to be adapted to conventional skateboards not manufactured with the intent of later adding a brake unit. Addition of the brake unit is accomplished by drilling the bore 26 through the rear truck, which is simplified due to the absence of any rotational axle within the portion of the truck through which the bore passes, as shown in FIG. 2. An additional pair of bores are provided for the mounting bolts at which point the apparatus as previously described can be attached.

Figure 5:
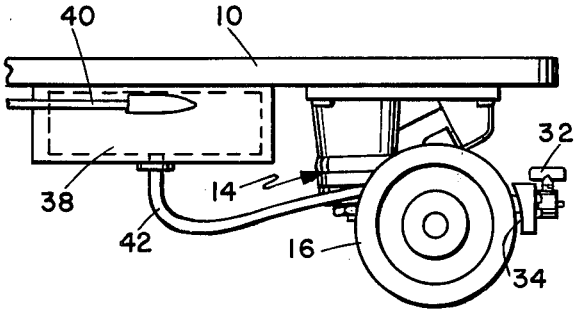
FIG. 5 is a side elevation view showing a retractable brake cable arrangement.

Modification of the system as above described is illustrated in FIG. 5 wherein a diagrammatically illustrated reel assembly 38 is mounted beneath the deck. The reel within the reel housing is springloaded to retract the portion 40 of the cable, which connects by means of a swivel or the like to a portion 42 of the cable which operates the braking structure. The spring-loaded reel structure would have the advantage not only of providing a tidy method of storing the cable, but would draw in slack cable by virtue of the spring tension such that when the rider is in a crouched position versus a more upright stance there would not be an unwieldly length of slack cable. It should be noted at this point that although a two-part cable has been described, it is conceivable that a single strand pull cable could be used within the other design parameters of the invention and a fluid filled cable operating a hydraulic brake might prove specifically adaptable to the skateboard, and particularly to the reel-wound cable variation. Thus the term "cable" as used in this description and the appended claims is used in quite broad a fashion to include the embodiment described and in essence any other elongated flexible member capable of effecting movement at one end by manipulating the other end, and serving the function of leash or a tether as a result inherent in this flexibility.

Figure 3:
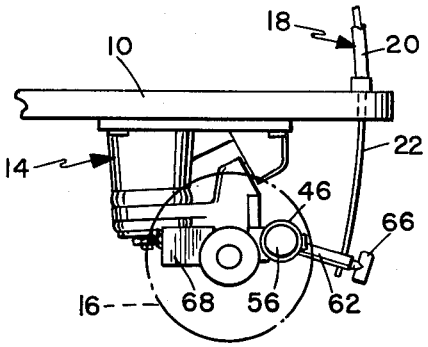
FIG. 3 is a side elevation view showing an alternative disc type brake.
Figure 4:
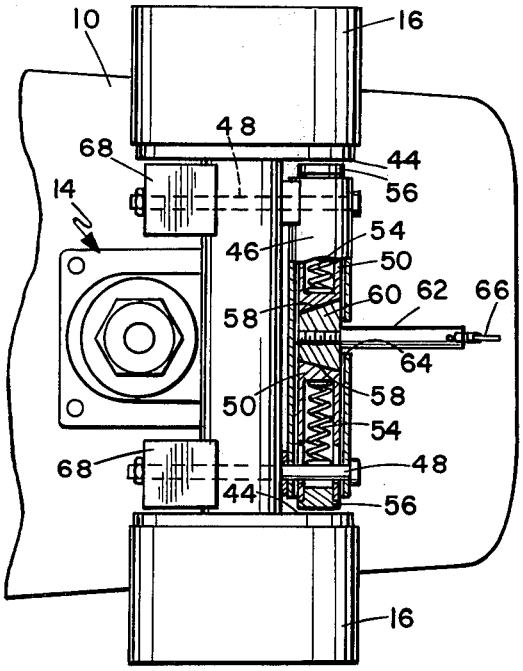
FIG. 4 is an enlarged underside view, partially cut away, of the structure of FIG. 3.

Turning to a second embodiment of the braking assembly illustrated in FIGS. 3 and 4, in this version the wheels may be provided with interior brake discs 44, although braking directly against the new urethane wheels has proven satisfactory. In this embodiment, a hollow tube 46 is mounted to the rear truck by bolts 48 in much the same fashion that the bar 28 is attached with the bolts passing centrally through the tube. Disposed within the tube are two oppositely directed pistons 50, is shown as cylindrical as is the tube although other shapes are possible and each of which has a longitudinally extended slot 52 to accomodate the bolt 48, the further effect being achieved that the pistons are thereby made nonrotational within the housing cylinder 46, although the slots 52 are of such dimension that axial expansion of the pistons is permitted to a certain degree. The interior ends of these pistons are closed, and inward spring tension is provided by means of coil springs 54 which abut against the bolts so that brake drag is not felt when the brakes are not in use.

The outer ends of the pistons seat frictional members 56 which bear against the brake discs when the brakes are operated. The inner ends of the pistons are bevelled as shown at 58, and a central wedging or expanding cylinder 60 is disposed between the two pistons and has a bevel on each opposed surface so that as this member rotates within the housing cylinder, both pistons are expanded outwardly and the pressure on the two is equalized.

The central wedging cylinder is activated by means of a lever arm 62 extending through a hole 64 in the housing cylinder, the hole providing the lever with sufficient lateral play to permit equalization of braking pressure. This lever receives the core of the cable 18 as best illustrated in FIG. 3, which is preferably connected by means of a wing-nut set screw 66 or other easily releasible means as was the case in the prior embodiment so that easy disconnection and reinstallation of the brake assembly is possible. The sheath 20 of the cable in this embodiment abuts against the upper deck as shown in FIG. 3, or it may seat in a socket provided in the deck, but in either case it can be seen that by squeezing the hand grip, the core is drawn upwardly operating the lever arm 62 and thus expanding the frictional braking elements 56 against the brake discs. Due to the tendency of the brakes to deform the rear axles forwardly, a pair of braking blocks 68 are engaged on the forward end of the bolts 48 narrowly clearing the wheels, such that axle distortion results in braking action of the sides of the wheels against these blocks.

Modifications of the two disclosed embodiments could of course be conceived, it being the purpose of this disclosure to illustrate two basic types of braking structure, the first utilizing brake shoes applied against the circumference of the wheels and the second utilizing brake supplied against the sides of the wheels. In either embodiment, or in obvious variations thereof, the brake assembly provides in economical and easily installable form a brake of superior effectiveness which is manually operable and does not interfere with maneuverability and balance of the skateboard.

I claim:

1. A skateboard assembly having a combination tether and hand brake comrpising:

(a) a deck portion having a cleared upper surface to provide a platform for the unfettered feet of the user, said deck portion also having an undercarriage sturcture;

(b) a plurality of truck means and support wheels journalled on said truck means in said undercarriage structure beneath said deck permitting steering said skateboard assembly completely by the use of the feet;

(c) a frictional member and means mounting same on said skateboard assembly beneath said deck and being movable such that said frictional member can move from a first position clear of said wheels to a second position frictionally engaging at least one of said wheels to brake same;

(d) a flexible Bowden wire cable having an outer sheath and an inner core, and doubling as a brake line and a tether, one end of said cable being mounted to said skateboard assembly such that said sheath is substantially immobile relative thereto and said core is connected to said frictional member such that axial motion of said core moves said frictional member between said first and second positions;

(e) a hand grip means mounted on the other end of said cable, said hand grip means being operable to displace said core axially relative to said sheath when said hand grip means is squeezed to brake said skateboard assembly, said cable representing the only connection between the rider and said skateboard save standing contact on said platform, whereby the operator of said skateboard may ride same with his feet and body completely unhindered, and upon engaging said hand grip in the hand have said skateboard assembly securely retained on the end of said cable and prevented from escaping and have complete braking control over said skateboard assembly as well.

2. In combination, a brake attachment and a skateboard assembly having a deck portion with a plurality of support wheels, including a pair of spaced coaxial wheels, mounted thereto said attachment comprising:

(a) a frictional member comprising a bar dimensioned to span said spaced wheels;

(b) mounting means mounted to said frictional member and attachable to a skateboard assembly mounting said bar to a skateboard to permit motion of said bar from a first position clear of said wheels to a second position frictionally engaging at least one of said wheels when said frictional member is mounted to a skateboard assembly;

(c) a flexible Bowden wire cable having the core thereof connected at one end to said frictional member with the sheath thereof engageable in a seat in said skateboard assembly, said cable being operated at the other end by means of a hand grip means to move said frictional member between said first and second position, whereby the user of said skateboard can brake same manually while riding; and (d) a quick-release means incorporated in said Bowden wire cable to permit quick manual release of said hand grip assembly and at least a portion of said cable to permit conventional operation of said skateboard.

3. A skateboard assembly comprising:

(a) a deck portion having an undercarriage structure;

(b) a plurality of support wheels journalled in said undercarriage beneath said deck;

(c) a frictional member and means mounting same on said skateboard assembly beneath said deck such that said frictional member is movable from a first position clear of said wheels to a second position frictionally engaging at least one of said wheels;

(d) a flexible Bowden wire cable operably connected at one end to said skateboard assembly to control said frictional member and being operable by means of a hand grip assembly mounted to the other end of said cable to move said frictional member between said first and second position, whereby the user of said skateboard can brake same manually while riding; and (e) a spring-loaded reel mounted to said skateboard for storing said cable.

* * * * *